US006276812B1

(12) United States Patent
Helbig et al.

(10) Patent No.: US 6,276,812 B1
(45) Date of Patent: Aug. 21, 2001

(54) ELECTRIC LAMP AND LIGHTING SYSTEM FOR SAID LAMP

(75) Inventors: Peter Helbig, Sontheim; Hans Wild, Gerstetten, both of (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/554,910

(22) PCT Filed: Sep. 17, 1998

(86) PCT No.: PCT/DE98/02748

§ 371 Date: May 22, 2000

§ 102(e) Date: May 22, 2000

(87) PCT Pub. No.: WO99/28949

PCT Pub. Date: Jun. 10, 1999

(30) Foreign Application Priority Data

Nov. 28, 1997 (DE) ..... 197 52 979

(51) Int. Cl.[7] ..... F21V 19/00; H01R 33/00

(52) U.S. Cl. ..... 362/226; 362/267; 313/318.01; 313/318.11

(58) Field of Search ..... 362/226, 267, 362/296, 306, 548, 549; 313/318.01, 318.05, 318.11, 318.12; 439/611, 619

(56) References Cited

U.S. PATENT DOCUMENTS 5,209,668 * 5/1993 Higano et al. ..... 439/57
5,216,318 * 6/1993 Van Dulmen et al. ..... 362/226
5,313,134 * 5/1994 Borgis et al. ..... 313/318.11

FOREIGN PATENT DOCUMENTS 86 15 923 U 7/1986 (DE) .
296 16 116 U 12/1996 (DE) .
0 188 261 A2 7/1986 (EP) .
0 490 702 A1 6/1992 (EP) .

* cited by examiner

*Primary Examiner*—Alan Cariaso
(74) *Attorney, Agent, or Firm*—William E. Meyer

(57) ABSTRACT

The invention relates to an electric lamp, comprising a base (3) having at least two V-shaped fixing plates (5; 6) with a first (5*a*, 6*a*) and a second elastic V-shaped limb (5*b*; 6*b*). The ends of the first V-shaped limb (5*a*, 6*a*) are formed on the base (3). The first V-shaped limb (5*a*; 6*a*) forms a location (7) to accommodate a tappet-like holder or connector part and the ends of the second V-shaped limb (5*b*; 6*b*) arm configured as free ends. The inventive lamp can be used in a sealed headlight of a motor vehicle and on a carrier plate fitted with several lamp holders and forming part of the tail lights of a motor vehicle.

11 Claims, 4 Drawing Sheets

ELECTRIC LAMP AND LIGHTING SYSTEM FOR SAID LAMP

Figure 1:
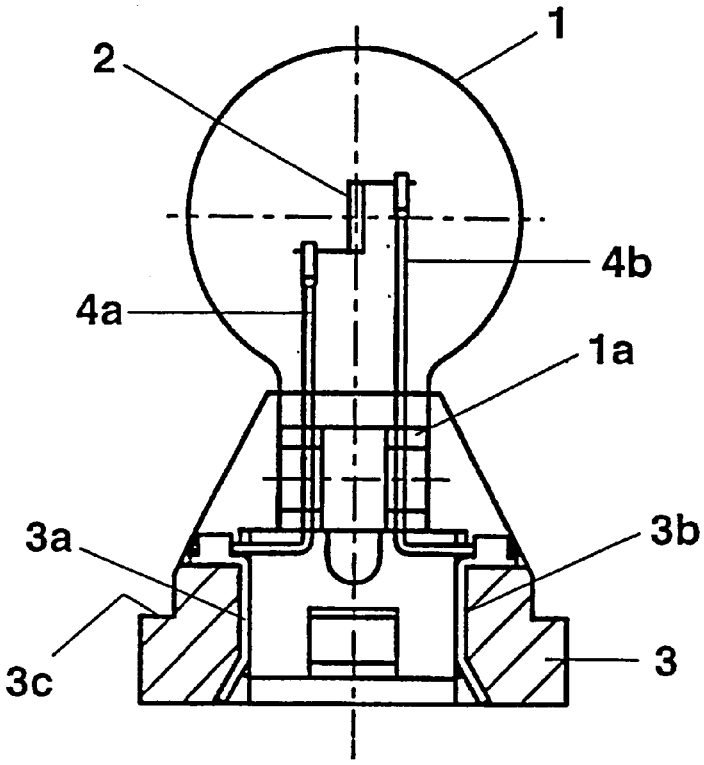

The invention relates to an electrical lamp as claimed in the preamble of patent claim 1 and to a lighting system for such lamps.

I. PRIOR ART

An electrical lamp corresponding to the preamble of patent claim 1 is disclosed, for example, in the German Utility Model 296 16 116. The lamp described in the abovementioned utility model is an incandescent lamp which is intended for use in a motor vehicle for generating the lighting functions of brake light, tail light or indicator light. The lamp base is embodied in this lamp, depending on the use, either as a plug or with slider contacts for printed circuit board mounting.

II. SUMMARY OF THE INVENTION

The object of the invention is to make available an electrical lamp with an improved lamp base which makes it possible to install the lamp both on a carrier plate, for example for use as an indicator light or brake light in the rear area of a motor vehicle, and in a sealed reflector, for example as an indicator light in a front head light of a motor vehicle.

This object is achieved according to the invention by means of the defining features of patent claim 1. Particularly advantageous embodiments of the invention are described in the subclaims.

The electrical lamp according to the invention has a base which is provided with at least two V-shaped attachment clips with elastic V-shaped limbs, the first V-shaped limbs forming a receptacle for a tappet-like holder component or plug component, and the ends of the first V-shaped limbs being integrally formed onto the base, while the ends of the second V-shaped limbs are embodied as free ends. These measures enable the lamp according to the invention to be installed both on a carrier plate which is equipped with lamp holders and in the rear installation opening, to be sealed, of a reflector element.

The electrical base contacts advantageously extend into the receptacle formed by the first V-shaped limbs and electrical contact is easily formed in this way between the base contacts and the holder contacts of the tappet-like holder component or plug component which is arranged between the first V-shaped limbs. In addition, the first V-shaped limbs advantageously have first latching noses which connect in a latching fashion with the holder component or plug component arranged in the receptacle between the first V-shaped limbs. The second V-shaped limbs are advantageously equipped at their free ends with second latching noses in order to make possible a latching connection between the lamp base and the edge of the installation opening in the reflector body. In addition, the free ends of the V-shaped limbs advantageously each have an oblique face which facilitates the insertion of the lamp into the installation opening of the reflector body.

According to a first preferred exemplary embodiment, the lighting system according to the invention has a carrier plate on which there is at least one lamp holder which has a tappet which is equipped with the electrical holder contacts, projects out of the carrier plate and is arranged between the first V-shaped limbs when the lamp is inserted. The first latching noses advantageously connect in a latching fashion to the tappet when the lamp is inserted.

According to a second preferred exemplary embodiment, the light system according to the invention has a reflector which has at least one installation opening for, in each case, one lamp, and at least one plug which is provided with a connection cable. The plug is equipped with attachment means for attaching it to the reflector and is equipped with a tappet-shaped projection which, after it has been mounted, is arranged in the receptacle formed by the first V-shaped limbs. In addition, the plug has at least two unlocking pins which, when the plug is fitted on, release the latching connection between the two latching noses and the reflector. The plug is also advantageously equipped with a sealing ring which bears against a flange, surrounding the installation opening, on the reflector and seals this opening. The electrical contacts of the plug are advantageously located on the tappet-like projection.

III. DESCRIPTION OF THE PREFERRED EXEMPLARY EMBODIMENTS

Figure 2:
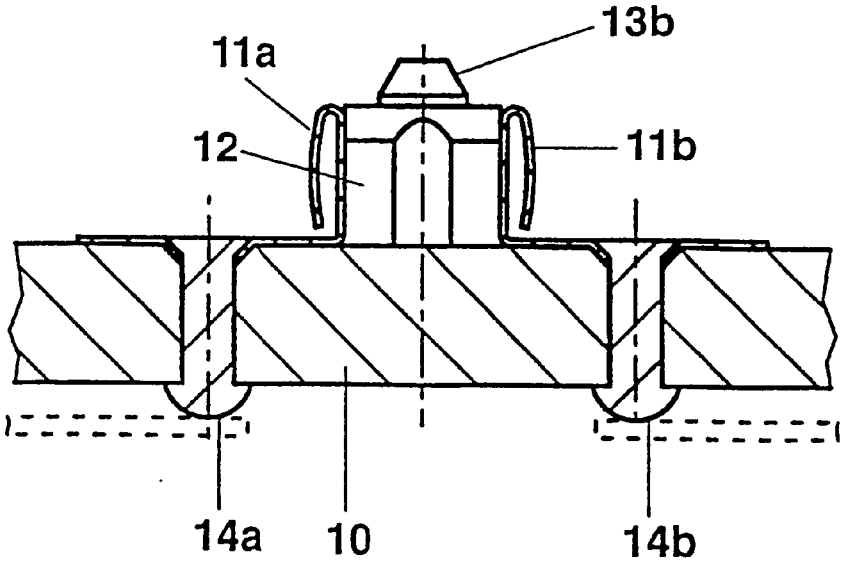
Figure 3:
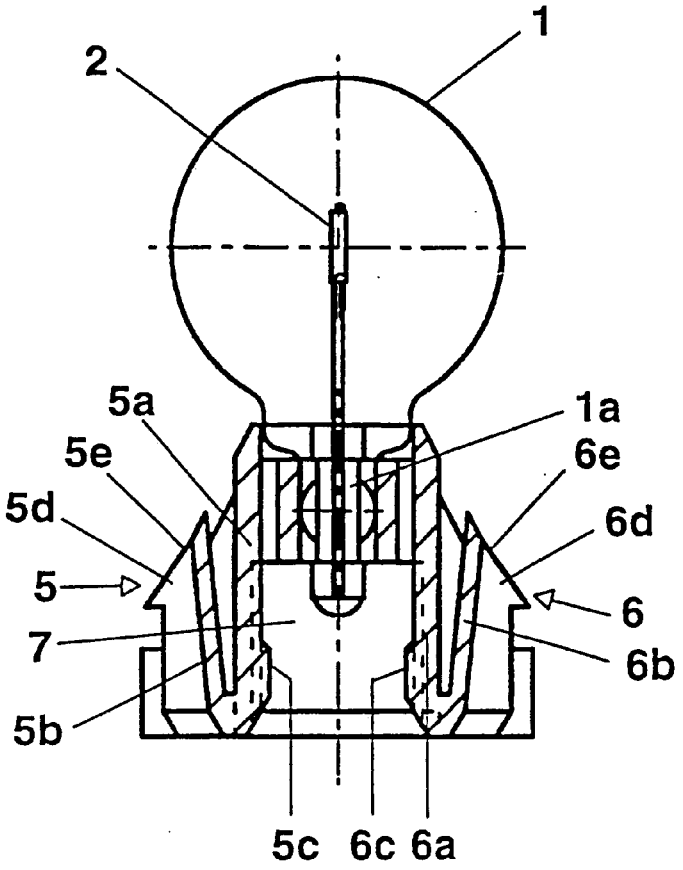
Figure 4:
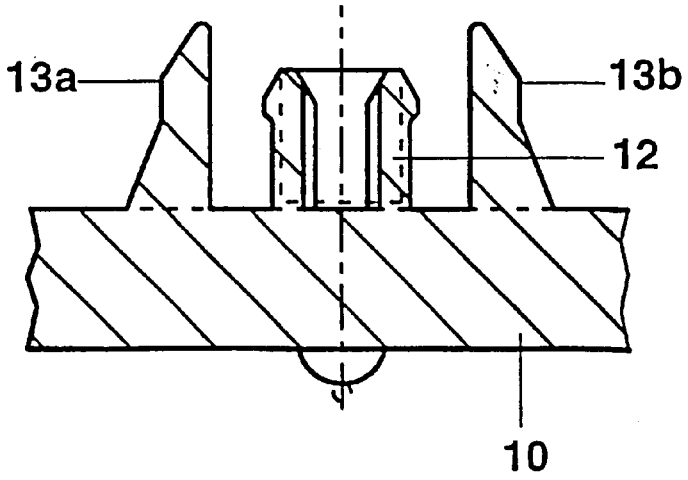
Figure 5:
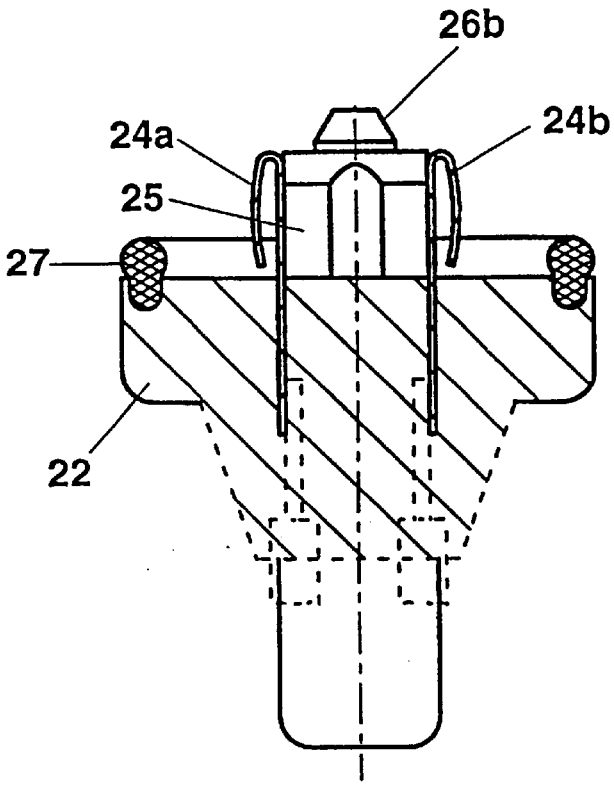
Figure 6:
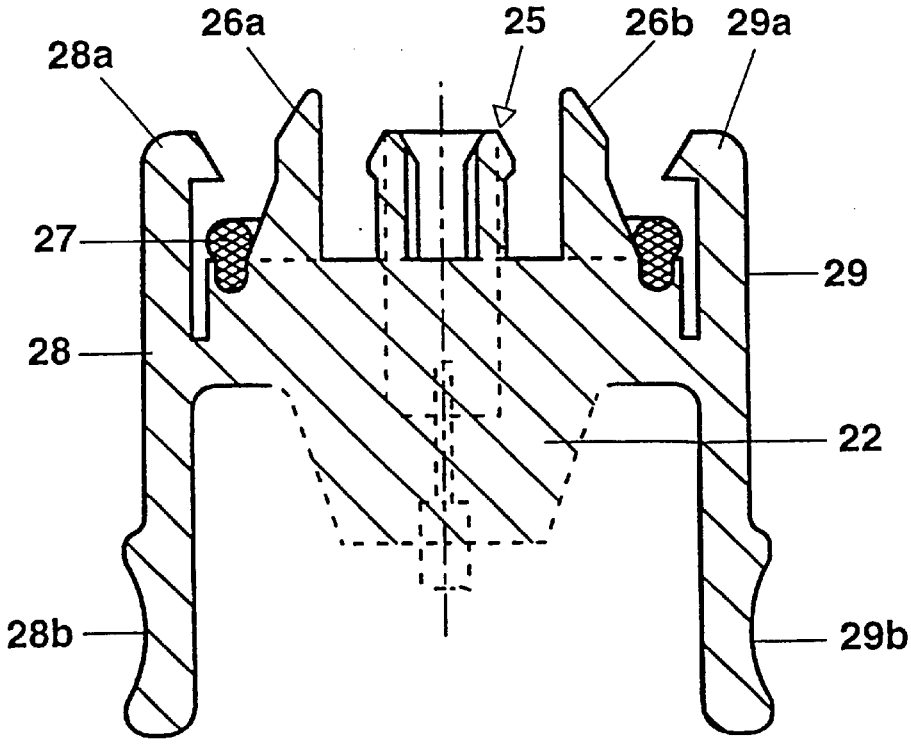
Figure 7:
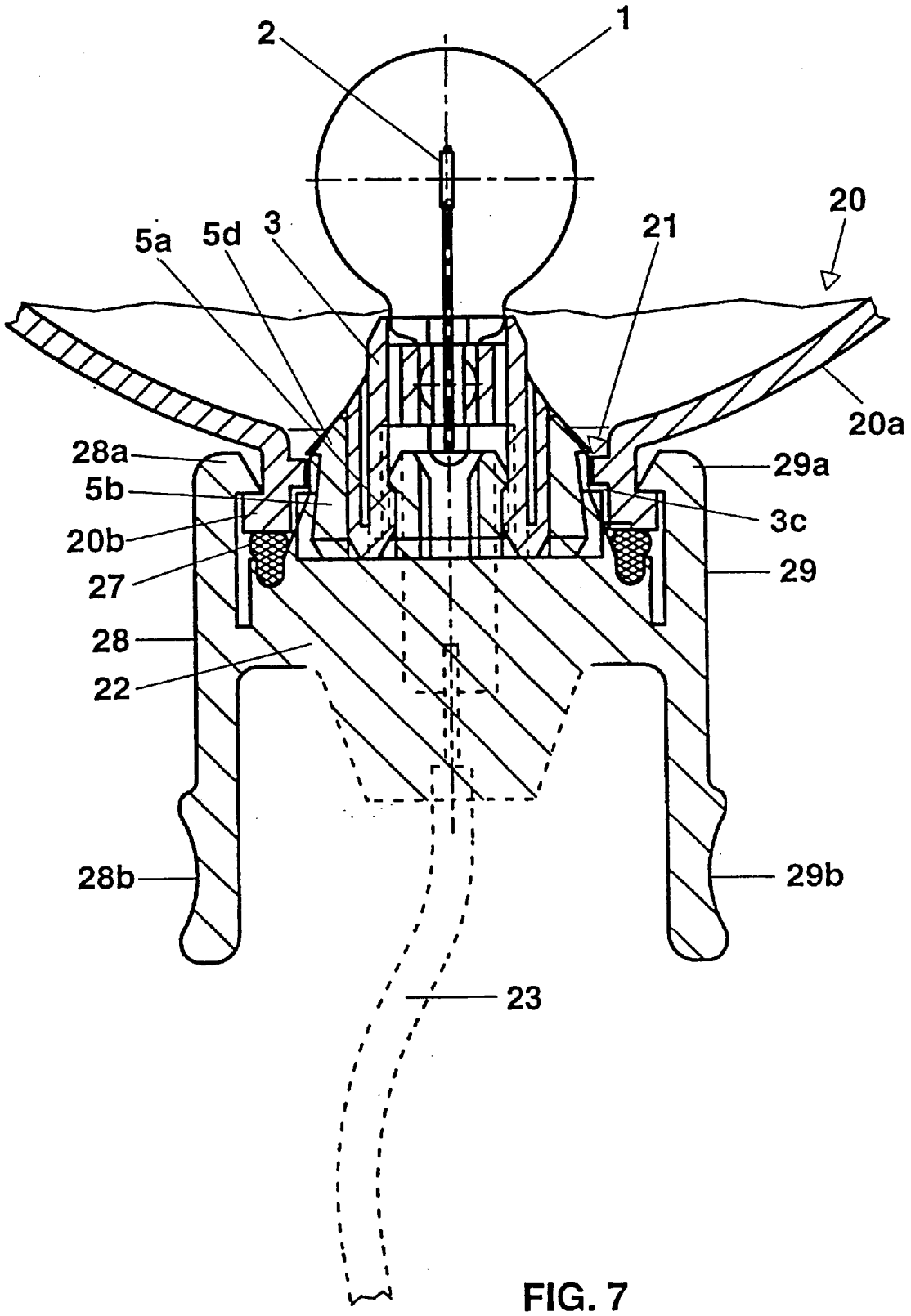

The invention is explained in more detail below with reference to the preferred exemplary embodiments. In the drawing:

FIG. 1 shows an electrical lamp according to the invention in a schematic, partially sectional side view, FIG. 2 shows a carrier plate equipped with a lamp holder in a schematic, partially sectional side view, FIG. 3 shows the electrical lamp from FIG. 1 in a schematic, partially sectional side view turned through 90 degrees, FIG. 4 shows the carrier plate according to FIG. 2 in a schematic, partially sectional side view turned through 90 degrees, FIG. 5 shows, in schematic, partially sectional side view, a plug for supplying power to the lamp according to FIGS. 1 and 3 which is arranged in a reflector, FIG. 6 shows the plug from FIG. 5 in a schematic, partially sectional side view turned through 90 degrees, FIG. 7 shows a side view of a light system according to the invention with a lamp according to FIGS. 1 and 3 which is mounted in a reflector, and a plug according to FIGS. 5 and 6 in a schematic, partially sectional view.

FIGS. 1 and 3 show an electrical lamp according to a preferred exemplary embodiment of the invention. This lamp has a glass lamp bulb 1 with an end 1*a* which has a gas-tight seal and from which two electrical current feeder lines 4*a*, 4*b* project, said electrical feeder lines 4*a*, 4*b* being connected in an electrically conductive fashion to a spiral wound filament 2 arranged within the lamp bulb 1. The sealed end 1*a* of the lamp bulb 1 is secured in a base 3 composed of plastic. The base 3 has two V-shaped attachment clips 5, 6 which each have a first V-shaped limb 5*a*, 6*a* and a second, elastic V-shaped limb 5*b*, 6*b*. The first V-shaped limbs 5*a*, 6*a* are integrally formed onto the base 3 by their ends and form a receptacle 7 for a tappet-like holder component or plug component, while the ends of the second V-shaped limbs 5*b*, 6*b* are embodied as free ends. The first V-shaped limbs 5*a*, 6*a* are equipped with first latching noses 5*c*, 6*c* which project into the receptacle 7, and the free ends of the second V-shaped limbs 5*b*, 6*b* are equipped with second latching noses 5*d*, 6*d*. The free ends of the second V-shaped limbs 5*b*, 6*b* have, in the vicinity of the second latching noses 5*d*, 6*d*, an oblique face 5*e*, 6*e* which facilitates the installation of the lamp in the installation opening of a reflector. The electrical base contacts 3*a*, 3*b* are arranged in the receptacle 7. The base 3 is also equipped with a support face 3*c*, which serves as a depth stop when the lamp is inserted into the installation opening of a reflector.

Two different possible applications of the incandescent lamp described above are explained in more detail below.

FIGS. 2 and 4 show a carrier plate 10 equipped with a plurality of lamp holders. For the sake of clarity, FIGS. 2 and 4 show only a detail of the carrier plate 10 with a single lamp holder. The lamp holder is composed of a tappet 12 which projects out of the carrier plate 10 and is provided with two electrical holder contacts 11*a*, 11*b*. The holder contacts 11*a*, 11*b* are connected to the electrical terminals 14*a*, 14*b* of the carrier plate 10. When the lamp is installed, the tappet 12 engages in the receptacle 7, with the result that the first V-shaped limbs 5*a*, 6*a* bear in a clamping fashion against the tappet 12, and the second V-shaped limbs 5*b*, 6*b* bear in a clamping fashion against the side walls 13*a*, 13*b* arranged on both sides of the tappet 12. In addition, the holder contacts 11*a*, 11*b* which are embodied as leaf springs make electrical contact with the base contacts 3*a*, 3*b* when the tappet 12 is inserted into the receptacle 7. The carrier plate 10 is, for example, a component of the rear lighting system of motor vehicles. A plurality of lamp holders for an indicator light, brake light and tailgate light are usually arranged on it.

FIGS. 5 to 7 show a second possible application of the lamp according to the invention shown in FIGS. 1 and 3. This lamp can be used not only on a carrier plate 10, such as explained above, but also equally well in a reflector which is sealed against the ingress of humidity. FIG. 7 shows a lighting system with the lamp according to the invention, a reflector and a plug for supplying power to the lamp. The reflector 20, which is for example the front headlight of a motor vehicle, has, on its rear wall 20, an installation opening 21 for a lamp according to the invention which is used, for example, to generate a front indicator light. The reflector wall 20*a* is also provided on the outside with a flange 20*b* which is used to attach a plug 22. Details of the plug 22 are illustrated in FIGS. 5 and 6.

The plug 22 has a tappet-like projection 25 which is equipped with the electrical plug contacts 24*a*, 24*b* and which, when the plug 22 is connected, engages in the receptacle 7 formed by the first V-shaped limbs 5*a*, 6*a*. In addition, the plug has two unlocking pins 26*a*, 26*b* which are arranged on both sides of the tappet-like a projection 25, a sealing ring 27, an electrical connecting cable 23 and two attachment clips 28, 29.

To install the lamp, it is introduced from the rear into the installation opening 21 of the reflector 20. Here, the second V-shaped limbs 5*b*, 6*b* bear in a clamping fashion against the edge of the reflector wall 20*a* in the vicinity of the installation opening 21. The second latching noses 5*d*, 6*d* engage on the inside behind the reflector wall 20*a*. The bearing face 3*c* of the lamp base 3 bears here against the outside of the reflector wall 20*a* and serves as a depth stop for the lamp. In order to connect the plug 22, the ends 28*b*, 29*b* of the attachment clips 28, 29 are pressed together. As a result, the ends 28*a*, 29*a* of the attachment clips 28, 29 which are embodied as grips can be attached behind the flange 20*b* of the reflector 20. Here, the sealing ring 27 of the plug 22 is seated on the flange 20*b* and seals the installation opening 21 of the reflector 20. In addition, the tappet-like projection 25 of the plug 22 engages in the receptacle 7 of the lamp base 3, as a result of which an electrical contact is made between the plug contacts 24*a*, 24*b* and the base contacts 3*a*, 3*b*. However, at the same time, the two unlocking pins 26*a*, 26*b* of the plug 22 also slide between the two V-shaped limbs 5*b*, 6*b* and the reflector wall 20*a* into the installation opening 21 and as a result release the latching connection between the two latching noses 5*d*, 6*d* and the reflector wall 20*a*, with the result that when the plug 22 is connected the lamp is attached only to the plug 22. When the plug 22 is removed again, the lamp is therefore removed immediately together with the plug 22 from the reflector 20.

What is claimed is:

1. An electrical lamp having a lamp bulb (1), at least one luminous element (2) arranged within the lamp bulb (1), a base (3) in which the lamp bulb (1) is secured and which is provided with electrical base contacts (3*a*; 3*b*), at least two current feeder lines (4*a*; 4*b*) which lead out of the lamp bulb (1) and are electrically conductively connected to the at least one luminous element (2) and to the base contacts (3*a*; 3*b*), characterized in that the base (3) has at least two V-shaped attachment clips (5; 6) each with a first V-shaped limb (5*a*; 6*a*) and a second elastic V-shaped limb (5*b*; 6*b*), the ends of the first V-shaped limbs (5*a*; 6*a*) being integrally formed on the base (3), the first V-shaped limbs (5*a*; 6*a*) forming a receptacle (7) for a tappet-like holder component or plug component, the ends of the second V-shaped limbs (5*b*; 6*b*) being embodied as free ends.

2. The electrical lamp as claimed in claim 1, wherein the first V-shaped limbs (5*a*; 6*a*) are equipped with first latching noses (5*c*; 6*c*).

3. The electrical lamp as claimed in claim 1, wherein the free ends of the second V-shaped limbs (5*b*; 6*b*) are provided with second latching noses (5*d*; 6*d*).

4. The electrical lamp as claimed in claim 3, wherein the second latching noses (5*d*; 6*d*) each have an oblique face (5*e*, 6*e*) at the free end of the second V-shaped limbs (5*b*; 6*b*).

5. The electrical lamp as claimed in claim 1, wherein the electrical base contacts (3*a*; 3*b*) project into the receptacle (7).

6. The electrical lamp as claimed in claim 1, wherein the base (3) has a support face (3*c*) which serves as a depth stop when the electrical lamp is installed in a reflector (20).

7. An lighting system having at least one electrical lamp as claimed in claim 1 and a carrier plate (10) which is provided with electrical terminals (14*a*; 14*b*) and on which at least one lamp holder which is equipped with electrical holder contacts (11*a*; 11*b*) is arranged, wherein the at least one lamp holder has a tappet (12) which is equipped with the holder contacts (11*a*; 11*b*), projects out of the carrier plate (10) and is arranged between the first V-shaped limbs (5*a*; 6*a*) when the lamp is inserted.

8. The lighting system as claimed in claim 7, wherein the first latching noses (5*c*; 6*c*) form a latching connection with the tappet (12).

9. A lighting system having at least one electrical lamp as claimed in claim 1 and a reflector (20) which has at least one installation opening for, in each case, one electrical lamp, and at least one plug (22) which is provided with a connecting cable (23) and electrical contacts (24*a*; 24*b*), wherein the plug (22) has attachment means (28; 29) which are provided for mounting the plug (22) on the reflector (20), the second V-shaped limbs (5*b*; 6*b*) come to bear in a clamping fashion in the vicinity of the mounting opening (21) on the reflector (20) when the lamp is installed and the plug (22) is not attached, with the result that the second latching noses (5*d*; 6*d*) connect in a latching fashion to the reflector (20), the plug (22) has a tappet-like projection (25) which, after the plug (22) is mounted on the reflector (20), is arranged in the receptacle (7) formed by the first V-shaped limbs (5*a*; 6*a*), the plug (22) has at least two unlocking pins (26*a*; 26*b*) which, after the plug (22) is attached on the reflector (20), act on the second V-shaped limbs (5*b*; 6*b*) in such a way that the latching connection of the second latching noses (5*d*; 6*d*) to the reflector (20) is released.

10. The lighting system as claimed in claim 9, wherein the tappet-like projection (25) is provided with the electrical contacts (24*a*; 24*b*) of the plug (22).

11. The lighting system as claimed in claim 9, wherein the plug (22) has a sealing ring (27) which seals the installation opening (21) after the plug (22) has been mounted on the reflector (20).

* * * * *